US005501541A

United States Patent [19]

Gomes

[11] Patent Number: 5,501,541

[45] Date of Patent: Mar. 26, 1996

[54] FLEXIBLE COUPLING DEVICE

[76] Inventor: Daniel Gomes, 12 Railroad Ave., P.O. Box 117, Worcester, N.Y. 12197-0111

[21] Appl. No.: 105,328

[22] Filed: Aug. 9, 1993

[51] Int. Cl.[6] ..... A47C 4/10; F16B 7/20; F16B 12/12

[52] U.S. Cl. ..... 403/41; 403/19; 403/220; 403/251; 411/338

[58] Field of Search ..... 403/41, 143, 145, 403/146, 19, 161, 251, 203, 220, 221; 411/338, 339, 510, 43; 24/33 C

[56] References Cited

U.S. PATENT DOCUMENTS

| | | | |
|---|---|---|---|
| 1,368,222 | 2/1921 | Foreman . | |
| 2,586,556 | 2/1952 | Mullikin | 411/339 |
| 2,629,909 | 3/1953 | Hall | 24/33 C X |
| 2,779,729 | 7/1956 | Jorgensen . | |
| 3,131,970 | 5/1964 | McGregor . | |
| 3,251,260 | 5/1966 | Serdechny | 411/338 |
| 3,570,418 | 3/1971 | Gooding . | |
| 3,907,359 | 9/1975 | Joiner . | |
| 4,023,239 | 5/1977 | Stolz | 403/41 |
| 4,199,189 | 4/1980 | Neumann . | |
| 4,322,109 | 3/1982 | Thebaud . | |
| 4,367,994 | 1/1983 | Francis et al. | 411/43 |
| 4,585,383 | 4/1986 | Kraemer | 411/43 |
| 4,588,227 | 5/1986 | Austin . | |
| 4,611,367 | 9/1986 | Meulenberg et al. | 24/33 C X |
| 4,636,106 | 1/1987 | Waisbrod | 403/221 |
| 4,743,068 | 5/1988 | Gomes . | |
| 4,759,670 | 7/1988 | Linder et al. | 411/43 |
| 4,969,785 | 11/1990 | Wright | 411/43 |
| 5,244,326 | 9/1993 | Henriksen | 411/339 |

FOREIGN PATENT DOCUMENTS

| | | | |
|---|---|---|---|
| 2372982 | 6/1978 | France . | |
| 926645 | 4/1955 | Germany | 24/33 C |
| 7904501 | 11/1980 | Netherlands . | |

OTHER PUBLICATIONS

C.S.B. Commodities Inc, Brochure, 1993.
Associated Bag Co., Jan. 1991, pp. 29–31.
Advertizement for Rapid Assembly Post & Screw, Ark–Plas Products Inc, May, 1988 USA, 2 pages.

*Primary Examiner*—Anthony Knight
*Attorney, Agent, or Firm*—Barnard, Brown & Michaels

[57] ABSTRACT

A flexible coupling device including a flexible metal rod or wire within a flexible tube which can be removably secured through the aligned bores of the pieces. The pieces are held in a fixed longitudinal relationship using the axial tension created by the flexible coupling device while still permitting relative rotation between each of the pieces. The flexible metal rod or wire is secured through various mechanism which include radial angular ridges in the interior of the flexible tube and a retaining post having radial angular ridges that interlock with the ridges in the flexible tube such that, as the post is inserted into the flexible tube, the post ridges and the tube ridges interlock to secure the flexible tube. In addition, radial angular ridges on the exterior of the flexible rod interlock with a retaining post having an interior bore with corresponding radial angular ridges as the flexible rod is inserted into the retaining post. The flexible rod can be pulled through the retaining post such that the excess of the flexible rod can be trimmed once it is secured.

12 Claims, 8 Drawing Sheets

FLEXIBLE COUPLING DEVICE

FIELD OF THE INVENTION

This invention relates to coupling devices and more particularly relates to flexible coupling devices that are used in easy to assemble knock-down furniture.

BACKGROUND OF THE INVENTION

This invention relates to a flexible coupling device that can be used with an article of knock-down furniture that can be easily assembled by the end-user.

Articles of furniture that consist of several pieces, each capable of rotation relative to each other, are well known. A typical example is the folding chair. One type of folding chair, known as "knock-down" furniture, has several pieces making up the seat, back and legs of the chair. In a typical design, each piece has a bore through which a metal rod is passed. Each piece is strung on this rod like beads on a string until the full complement of pieces has been reached to create a portion of the chair. The pieces are held in place on the rod by some fastening means at the ends of the rod. When the article of furniture is completely assembled, each portion of the chair is capable of rotation relative to each other, thereby allowing the knock-down chair to fold out into an open position for use, or to fold into a closed compact position suitable for storage.

When the article of furniture has some contour to its seat or back portions, the metal rod has been replaced by metal wire, such as 12 gauge fence wire. The flexibility of the wire allows it to conform to this contour. This transverse flexibility is necessary when the contoured article of furniture is folded into its closed position. The wire is typically bent at the ends and driven back into the end pieces. A knock-down chair of this design usually has to be assembled by the manufacturer because the procedure and tools required are beyond the means of the average consumer. Even when assembled by the manufacturer, the wire tends to slowly cut into the furniture material (especially wood) and eventually the chair becomes loose and wobbly.

A common problem with most knock-down furniture items is that they are not designed to be easily assembled by the end-user and still retain the high quality of manufacturer assembled furniture. For high quality, durable furniture, pre-assembly of the furniture by the manufacturer is typically required, thereby increasing the production and shipping costs of the item. In addition, the end-user cannot easily adjust the pre-assembled furniture should the item become loose. This invention addresses these problems of ease of assembly, ease of adjustment and cost-effectiveness, by replacing the use of metal rod or metal wire to couple the pieces of an article of knock-down furniture.

U.S. Pat. Nos. 4,743,068 and 4,958,425 each teach a knock-down furniture coupling device that eliminates some of the problems described above. The coupling devices were used to combine pieces at a plurality of hinge arrangements, each hinge arrangement having a first and a second end piece and a selection of pieces sandwiched between these end pieces. An aligned bore extends through each of the plurality of pieces at each of the hinge arrangements. At each of the hinge arrangements a plastic tube is extended through each of the aligned bores. The tube has a length slightly shorter than the effective length of the aligned bore. A hanger bolt is threaded into each end of the plastic tube prior to assembly. A cap nut is threaded onto the exposed threads of each hanger bolt, once the plastic tube has been located within the aligned bore in each of the hinge arrangements. The cap nuts at each end of the plastic tube are in bearing contact with the end pieces, and are tightened against these end pieces in order to place the tube in tension. The furniture pieces are, consequently, held in longitudinal compression between the two cap nuts, while remaining free to rotate about the longitudinal axis of the tube. Each element of the particular article of knock-down furniture, e.g., the seat, back and legs in the case of a chair, is thus combined and interfaced using this tube assembly at each hinge arrangement in such a manner that the article of furniture is fully collapsible in a closed position, and extendable to its normally operative arrangement in an open position.

While this system was a significant advance in the art of flexible coupling devices, over time several problems have been discovered. The present application teaches the solutions to these newly discovered problems.

At temperatures above 90° the nylon hydraulic tubing which was taught in the patents listed above becomes slightly less rigid (it softens) and deforms under pressure. When a heavy person sits on the chair, especially in hot weather, over time the chair begins to gradually recline beyond the maximum point of recline. This happens because the tubing deforms under the shearing pressure of the intersecting pieces of the chair (2 long bolts) where the back assembly meets the seat assembly.

While a solid rod rather than tubing would be an improvement (greater shearing resistance) it is considerably more expensive and also more cumbersome to use (it comes in 10 to 20 ft lengths whereas the tubing comes in 500 ft rolls). Plus each end of the rod would need to be precisely drilled for later insertion of the lag bolts, thus increasing production costs and making the end product more expensive.

The object of the present invention is to provide coupling device that is a simple solution to these problems and increases the durability of the furniture without adding significantly to the cost of production.

SUMMARY OF THE INVENTION

The above mentioned object of the present invention, which will hereinafter become more readily apparent from the following description.

The present invention relates to a flexible coupling device for coupling a plurality of pieces each including an aligned bore. The flexible coupling device comprises a flexible rod or tube and means for removably securing the flexible tube through the aligned bores of the pieces, and in axial tension between, thereby holding each of the pieces in a fixed longitudinal relationship, while permitting relative rotation between each of the pieces.

The present invention solves the problem of deformation of the flexible tubing by placing a flexible metal rod or wire within the flexible tube. This metal rod does not materially affect the flexibility of the coupling device, however, it provides a significant increase in the sheer resistance of the flexible portion of the coupling device. This combines the durability of metal with the advantages of a relatively thick tube that does not cut into the pieces being coupled.

In addition to the improved flexible portion of the coupling device, new securing means have been developed. The first embodiment provides radial angular ridges in the interior of the flexible tube and a retaining post having radial angular ridges that interlock with the ridges in the flexible tube such that as the post is inserted into the flexible tube the post ridges and the tube ridges interlock to secure the flexible tube. The second embodiment provides radial angular ridges on the exterior of the flexible rod and a retaining post having an interior bore with radial angular ridges that interlock with the ridges on the flexible rod such that as the flexible rod is inserted into the retaining post, the post ridges and the rod ridges interlock to secure the flexible rod. The flexible rod can be pulled through the retaining post such that the excess of the flexible rod can be trimmed once it is secured.

The present invention also teaches a sleeve to prevent the rotation of the rod or tube within the piece that is being bound. The sleeve has an inner bore with retaining projections that engage a rod or tube inserted into the sleeve and retaining projections on the exterior of the sleeve that engage the interior of a bore in a piece when the sleeve is inserted into the bore such that the sleeve prevents that rotation of the tube or rod within the bore.

A more complete understanding of the invention and its advantages will be apparent as the detailed description is considered in connection with the accompanying drawings.

DETAILED DESCRIPTION OF THE INVENTION

The following provides a detailed description of the specific methods and materials used to practice the present invention. It should be understood that modifications can be made to the procedures disclosed below that would still be anticipated by the present invention.

Figure 1:
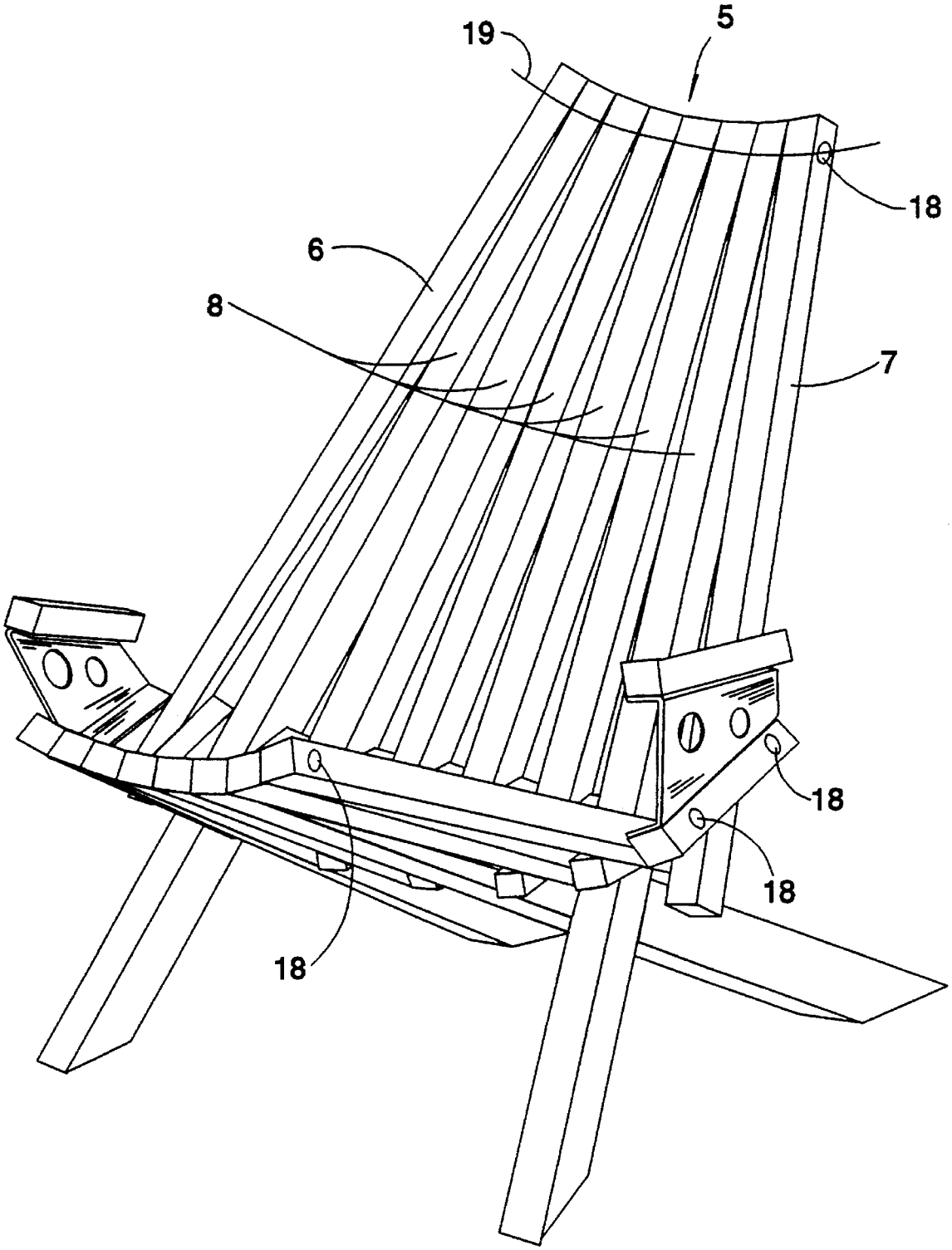
FIG. 1 is a perspective view of an article of knock-down furniture embodying the present invention, shown in the open position.
Figure 2:
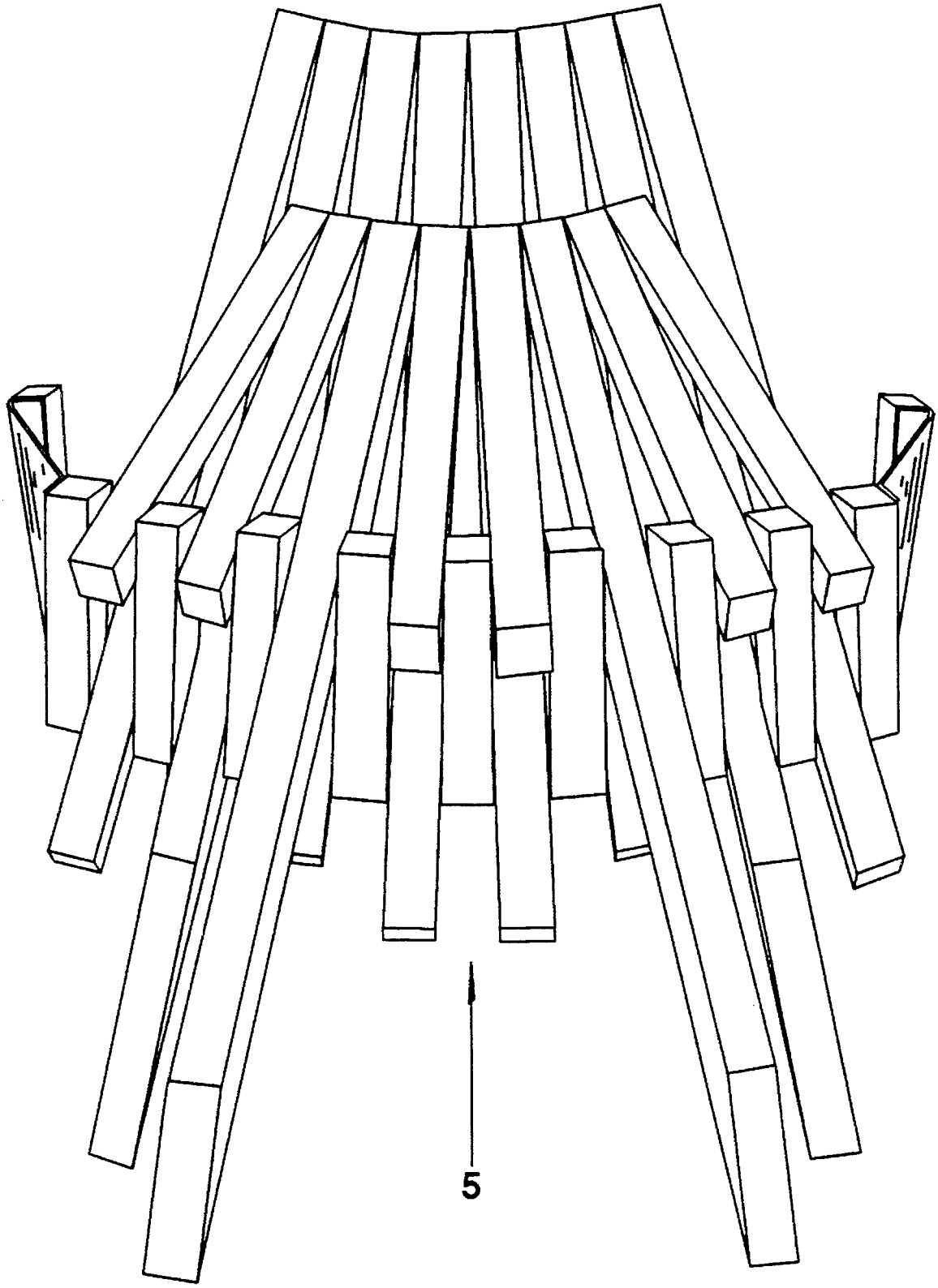
FIG. 2 is a perspective view of the article of furniture of FIG. 1, shown in the closed position.

An article of knock-down furniture 5 is shown in FIG. 1 in the assembled configuration and comprises a plurality of pieces 8. These pieces 8 are formed to constitute the elements of this article of furniture—namely, the legs, seat and back of the chair. The pieces are held in this configuration by a number of contact joint arrangements 18, each adjustably constrained against end pieces, such as pieces 6 and 7 in FIG. 1. Each contact joint arrangement is flexible to allow the pieces to be formed into a contour 19. In addition, the contact joint arrangement is designed to allow the pieces to rotate relative to each other so that the article of furniture 5 can be folded into a closed position, as shown in FIG. 2.

Figure 3:
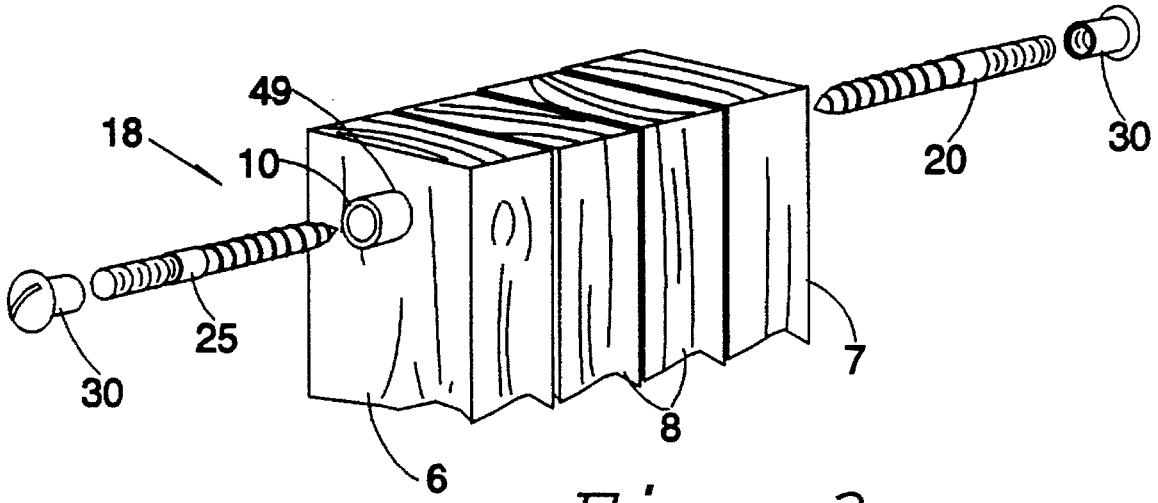
FIG. 3 is an enlarged exploded view of a contact joint of the article of furniture of FIG. 1.
Figure 4:
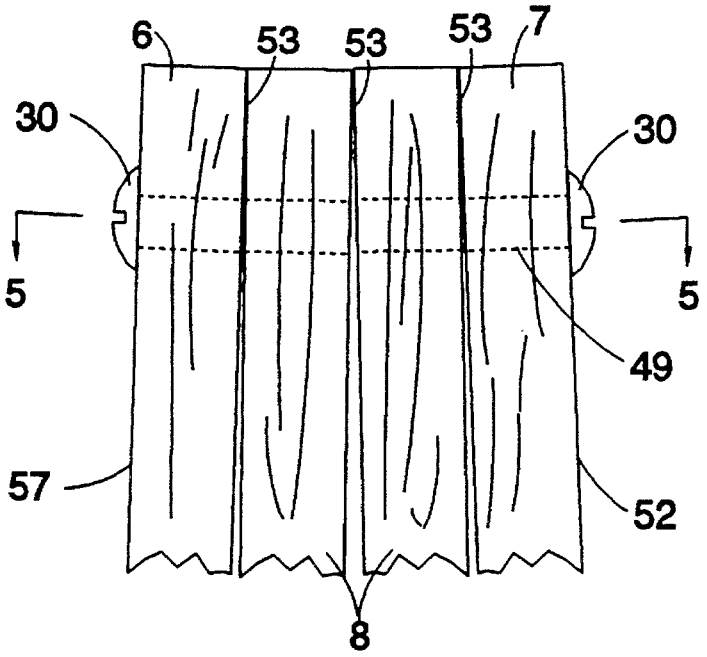
FIG. 4 is an enlarged front elevational view of the contact joint in FIG. 3, shown in the assembled configuration.

The basic elements of the contact joint arrangement are illustrated in the exploded view of FIG. 3. An aligned bore 49 extends through each of the pieces 6, 7 and 8. A flexible plastic tube 10 has hanger bolts 20 and 25 threaded into each end of the tube. The tube and hanger bolt assembly is passed through the bore 49. A cap nut 30 is threaded onto each hanger bolt 20 and 25 at each end of the tube. The cap nuts at each end are tightened against the outer surface 57 and 52 of the end pieces 6 and 7, respectively, as shown in FIG. 4. As the cap nuts are tightened, the tube 10 is placed in tension, which is reacted as a compressive force through the cap nuts 30 to restrain the pieces 6, 7 and 8. The pieces contact each other at joints 53. The contact joint arrangement can flex at these joints 53 to allow the pieces to assume a contour, or to change contour when the article of furniture is folded into its closed configuration. The amount of tension in the tube 10 determines the tautness of the contact joint arrangement and, consequently, the rigidity of the contour formed by the pieces 6, 7 and 8.

Figure 5:
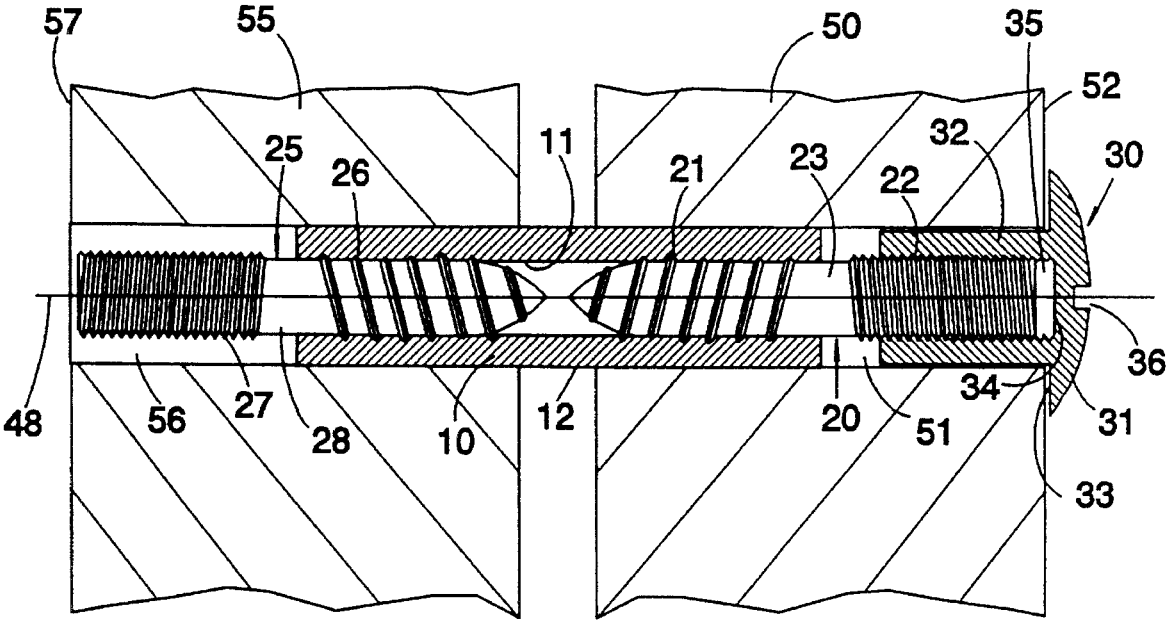
FIG. 5 is an enlarged cross-sectional view of a portion of the section of 5—5 of FIG. 4, viewed in the direction of the arrows.

The details of the contact joint arrangement are shown in FIG. 5. For purposes of clarity, only a first end piece 50 and a second end piece 55 are shown, although it is understood that a number of similar pieces are typically sandwiched between these end pieces in a final configuration. The pieces 50 and 55 each have a bore 51 and 56, respectively, with the central axis of the bores in alignment on a common axis 48 to form the common bore 49. In the present embodiment, the flexible tube 10 having an inner circumferential surface 11 and an outer surface 12, is cut to a length slightly shorter than the combined length of the common bore 49, so that the tube can be located fully within the combined bore when the pieces are strung together, as illustrated in FIG. 4.

Various means for restraining a flexible tube or rod within the bore are provided. Typically, a hanger bolt 20 is threaded into the inner surface 11 of the tube 10 prior to the tube being inserted into the common bore 49. The hanger bolt 20 has a first threaded section 21, in threaded engagement with the inner surface 11, a gripping section 23 to facilitate threading the first threaded section 21 into the tube 10, and a second threaded section 22. During installation, the bolt 20 is threaded into one end of the tube 10 leaving at least the second threaded section 22 exposed beyond the end of the tube. Similarly, another hanger bolt 25, having a first threaded section 26, a gripping section 28, and a second threaded section 27, is threaded into the inner surface 11 at the opposite end of the tube 10. Also, prior to the tube 10 being inserted into the common bore 49, some means is provided to constrain the hanger bolts 20 and 25 against the pieces 50 and 55, respectively. One preferred means has been a cap nut 30 threaded onto the second threaded section 22 of the hanger bolt 20. The cap nut 30 has a head portion 31 having a mounting surface 33, and a threaded portion 32 extending perpendicularly from the mounting surface 33. The mounting surface 33 has an effective diameter greater than the effective diameter of the common bore 49 so that the head portion cannot pass through the bore. The threaded portion 32 has an interior circumferential surface 34 with internal receiving threads 35 formed in the surface 34. The second threaded section 22 of the bolt 20 is, thus, in threaded engagement with these internal receiving threads when the cap nut 30 is threaded onto the hanger bolt 20. Any means to tighten the cap nut onto the hanger bolt is acceptable, however, the preferred method to date has been the provision of a screwdriver slot 36 in the head portion 31 of the cap nut 30 to receive a screwdriver for facilitating threading the cap out 30 onto the hanger bolt 20.

Figure 6:
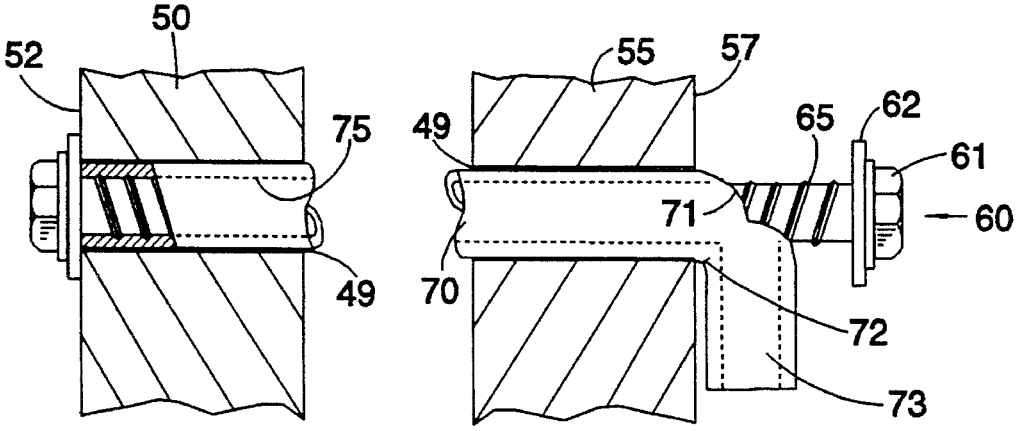
FIG. 6 is an enlarged cross-sectional view of a portion of a second embodiment of the present invention showing one end of the means for coupling a plurality of pieces in the assembled position another end in the unassembled configuration.

In a further variation on this embodiment, the tube 10 may be longer than the effective length of the common bore 49. During assembly, the tube is stretched within the bore, a notch or a hole is cut in the tube adjacent to the end outer surface 52, and a screw is inserted therein as shown in FIG. 6. The excess tube can be severed and discarded.

Figure 11:
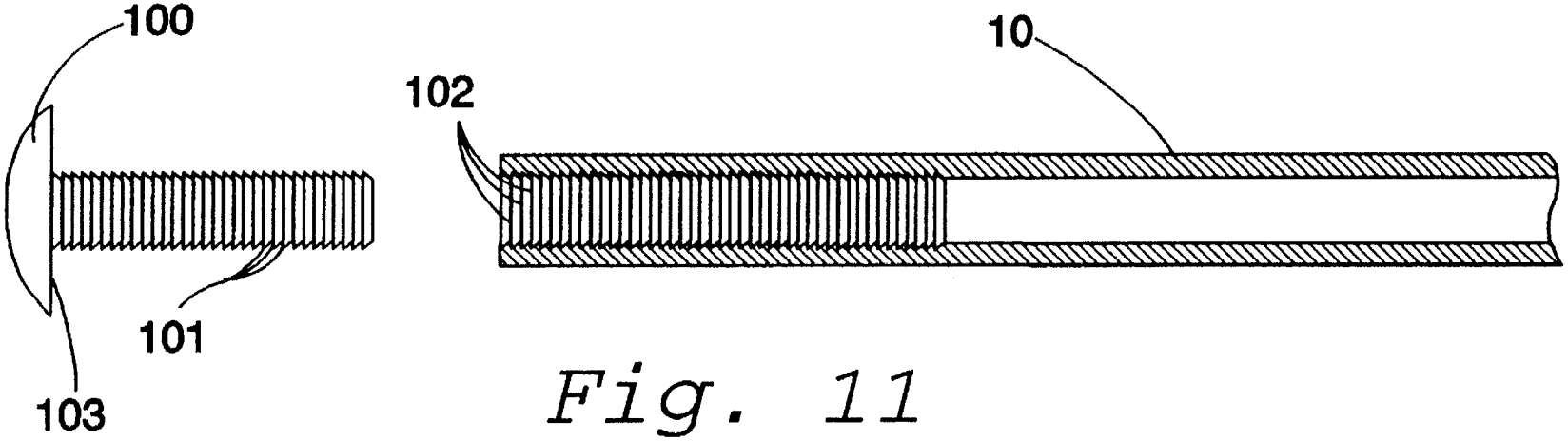
FIG. 11 is a cross-sectional view of a flexible coupling device securing means with a retaining post with exterior ridges and a flexible tube with interior ridges.

FIG. 11 shows a flexible coupling device securing means with a retaining post 100 with exterior ridges 101 and a flexible tube 10 with interior ridges 102. The radial angular ridges 102 in the interior of the flexible tube 10 interlock with the radial angular ridges 101 of the retaining post 100. The retaining post 100 has a mounting surface 103 with an effective diameter larger than the effective diameter of the aligned bore 49 such that as the post 100 is inserted into the flexible tube 10 the post ridges 101 and the tube ridges 102 interlock to secure the flexible tube 10.

This embodiment is a quick and efficient method of securing the flexible tube 10. The tube 10 would be placed inside of the common bore 49 and the post 100 would be inserted into the tube 10 at either end. The post 100 could be hammered lightly to increase tension or the pieces of the assembly could be compressed while the posts 100 are inserted into the tube 10 and then the tension released. This eliminates any problems with twisting of the tube 10 sometimes encountered when using the screw type retaining means discussed above.

Figure 12:
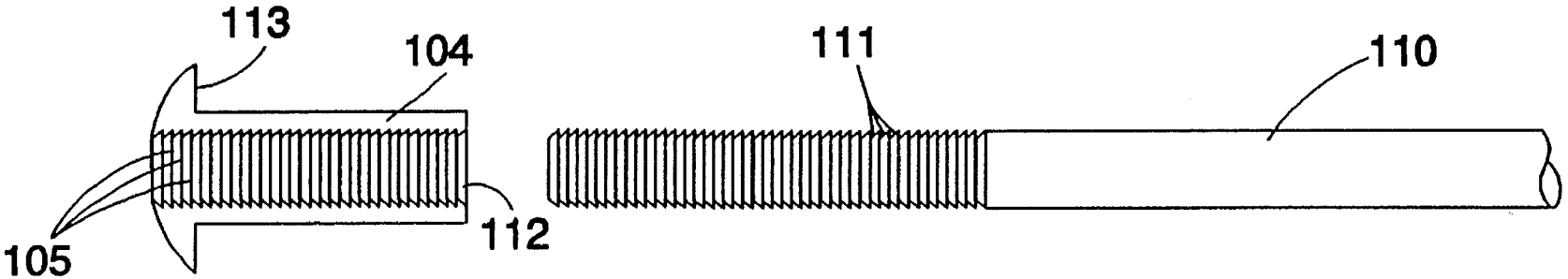
FIG. 12 is a cross-sectional view of a flexible coupling device securing means with a retaining post with interior ridges and a flexible rod with exterior ridges.

FIG. 12 shows a flexible coupling device securing means with a retaining post 104 with interior ridges 105 and a flexible rod 110 with exterior ridges 111. This embodiment utilizes a flexible rod 110 which is generally more expensive than a flexible tube 10, however, the cost may be made up in the savings in labor because the rod 110 can be easily pulled straight through the post 104 quickly and then the excess cut off. This embodiment is the easiest to use and the ability to use the excess rod 110 coming through the post 104 is a significant advantage for pulling the assembly taut.

The flexible rod 110 has a first and second end each having radial angular ridges 111 on the exterior of the flexible rod 110. A first and second retaining post 112 are provided for each end of the rod 110. Each retaining post 112 has a mounting surface 113 with an effective diameter larger than the effective diameter of said aligned bore 49. The interior bore of the post 112 has radial angular ridges 105 that interlock with the ridges 111 on the flexible rod 110. As the flexible rod 110 is inserted into the first and second retaining posts 112 the flexible rod 110 is secured through the aligned bores 49 of the pieces, and in axial tension between, thereby holding each of the pieces in a fixed longitudinal relationship, while permitting relative rotation between each of the pieces.

Figure 13:
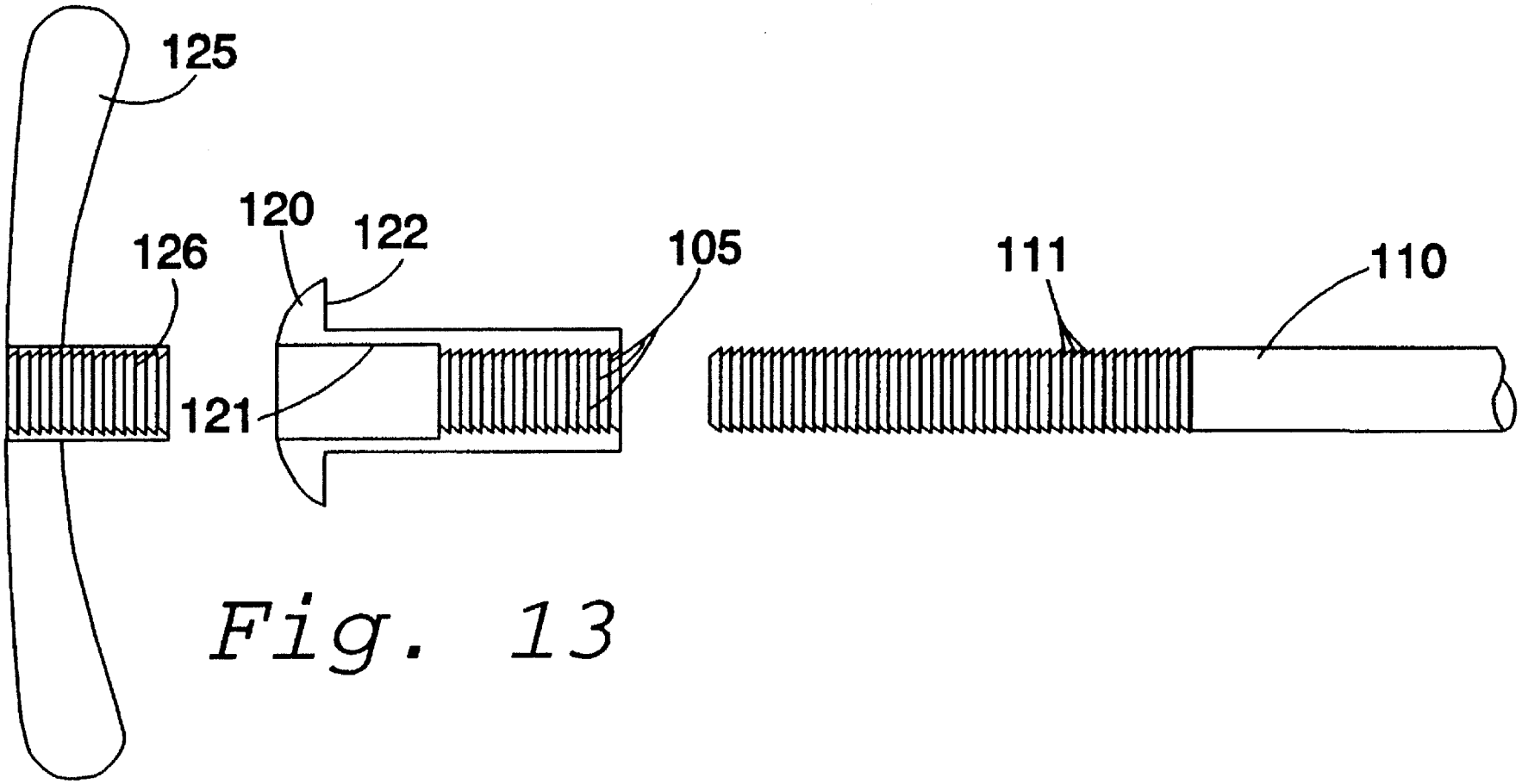
FIG. 13 is a cross-sectional view of a flexible coupling device securing means with a retaining post with interior ridges and a flexible rod with exterior ridges wherein the retaining post has a larger bore to allow a tool with interior ridges to engage the exterior ridges of the flexible rod.

FIG. 13 shows a flexible coupling device securing means with a retaining post 120 with interior ridges 105 and a flexible rod 110 with exterior ridges 111. The retaining post 120 has a larger bore 121 to allow a tool 125 with interior ridges 126 to engage the exterior ridges 111 of the flexible rod 110. Typically, the wood in chairs will shrink and the plastic in the rod 110 may stretch a bit. The tool 125 provides a convenient way to tighten the improved flexible coupling device after assembly and the rod 110 has been trimmed.

During assembly, one end of the tube or rod is inserted into the common bore 49 until a mounting surface of the cap nut or retaining post abuttingly engages the end outer surface 52 of the first piece 50. In this configuration, the opposite end of the tube, and particularly the second threaded section 27 of the hanger bolt 25, is near the end outer surface 57 of the second piece 55. A second cap nut or retaining post is then engaged with the end of the tube or rod. Now that both ends of the rod or tube are secured, the tension is increased until the mounting surface of the cap nut or retaining post is abuttingly engaged with the outer surface 57 of the second piece 55.

As the cap nuts or retaining posts are tightened, the tube or rod is put into increasing longitudinal tension. This longitudinal tension holds the mounting surface of the cap nuts or retaining posts against the end outer surfaces 52 and 57, consequently holding the first and second pieces 50 and 55 in compressed engagement. The longitudinal tension holds the pieces together while permitting each piece to rotate about the longitudinal axis of the tube relative to the tube and relative to each other. The flexibility of the tube or rod and the degree of tension put on it also allow the tube or rod, and consequently the pieces, to assume a contour shape. It is understood that additional pieces, each having a bore, can be strung onto the tube rod between the first and second end pieces, and held in position by the longitudinal tension in the tube or rod.

In the embodiment shown in FIG. 6, the first and second pieces 50 and 55 each have a bore 51 and 56, respectively, and are abutted as previously described to form a common bore 49. A flexible tube 70 has a hole or a rounded notch 71 cut near one end of the tube and extending substantially through the tube to a tear segment 72. This notch can be cut into the tube prior to or after the tube 70 has been inserted into the common bore 49. An excess lead portion 73 is extended from the notch 71 to the end of the tube 70. The tube is of sufficient length so that the excess lead portion 73 extends beyond the common bore 49 when the remainder of the tube is fully within the common bore. A screw assembly 60 is threaded into the interior circumferential surface 75 of the tube 70 at the end opposite the end with the notch 71. The screw assembly 60 comprises a typical sheet metal screw 61 extending through a washer 62. The washer 62 has an effective diameter greater than the effective diameter of the common bore 49 to prevent the screw assembly 60 from passing through the common bore. The metal screw has a threaded portion 65 that is threaded into the tube.

The end of the tube 70 having the notch 71 is extended through the common bore 49 until the washer 62 abuts the end outer surface 52 of the first piece 50. In this position, the notch 71 and tear segment 72 will be slightly recessed within the common bore 49, while the excess lead portion 73 will extend beyond the end outer surface 57 of the second piece 55. The lead portion 73 is pulled until the hollow tube 70 is taut. A second screw assembly 60 is inserted through the notch 71 and threaded into the inner circumferential surface 75 of the tube 70, as shown in FIG. 6. The lead portion 73 is held against the end outer surface 57 while the screw assembly is inserted in order to prevent rotation of the tube 70 while the screw assembly is threaded into the inner circumferential surface 75. The threaded portion 65 of the sheet metal screw 61 is threaded into the tube until the washer 62 abuts the end outer surface 57 of the second piece 55. The tear segment 72 and a portion of the excess lead portion is pinched between the washer 62 and the end outer surface 57. The excess lead portion 73 is separated from the tube 70 at the tear segment 72 so that no piece of the tube projects beyond the washer 61 and the remainder of the tube 70 is contained within the common bore 49. The screw assembly 60 in either end of the tube is tightened to place the tube in longitudinal tension.

The applicant has discovered that the flexible tube or rod tends to become twisted in the embodiments that employ a screwing action to increase the longitudinal tension. This twisting can interfere with the proper function of the furniture and prevent proper tightening of the securing means.

Figure 10:
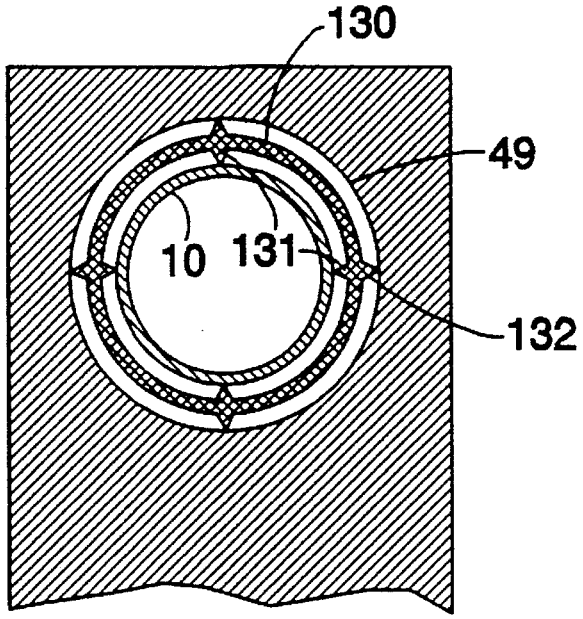
FIG. 10 is a side view of a retaining sleeve of the present invention being used.
Figure 9:
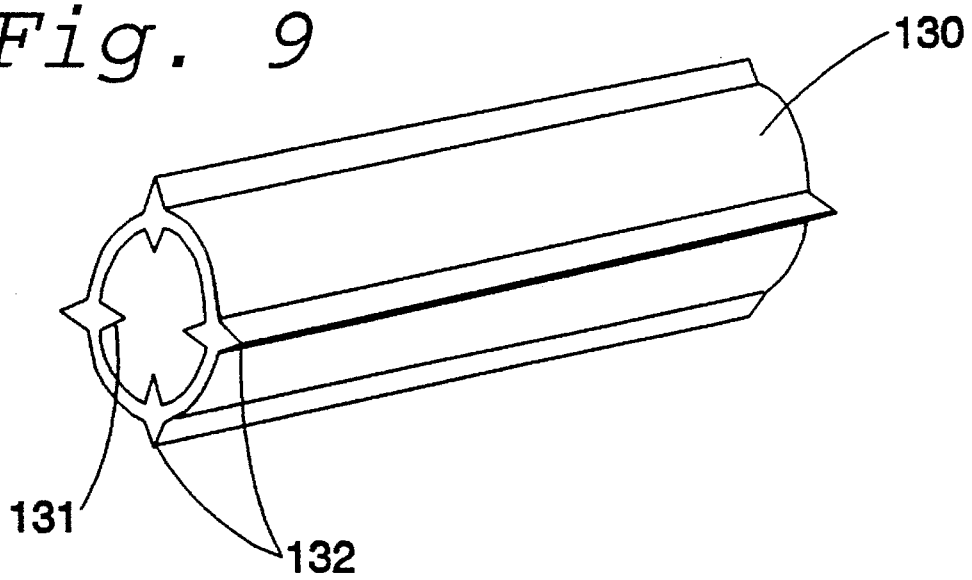
FIG. 9 is a perspective view of a retaining sleeve of the present invention.

Therefore, a retaining sleeve 130 is provided as shown in FIG. 9 and 10. The retaining sleeve 130 has an inner bore with retaining projections 131 that engage a rod or tube inserted into the sleeve and retaining projections 132 on the exterior of the sleeve 130 that engage the interior of a bore in a piece. When the sleeve 130 is inserted into the bore, the sleeve 130 prevents that rotation of the tube or rod within the bore due to the resistance caused by the projections 131 and 132.

Figure 7:
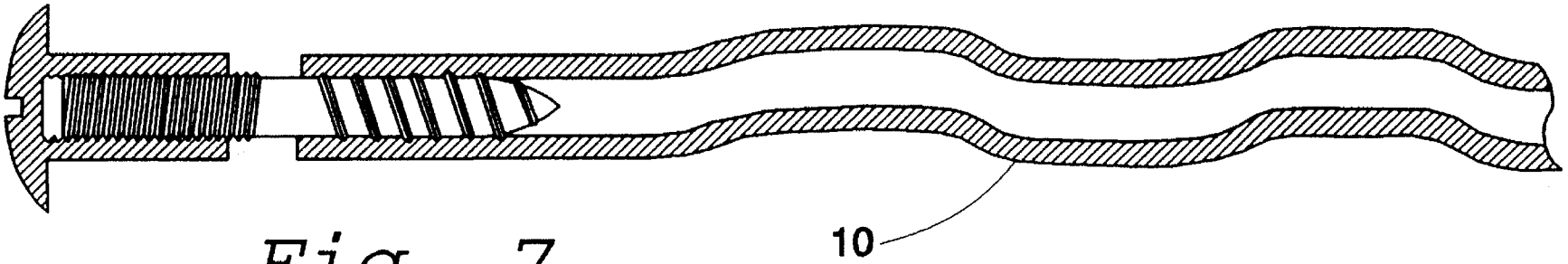
FIG. 7 is a cross-sectional view of a portion of a flexible coupling device shown in FIG. 5 that has deformed slightly.

The applicant has also discovered that high heat or heavy loads can cause flexible tubing to deform as shown in FIG. 7. Over time the chair begins to gradually recline-beyond the maximum point of recline. This happens because the tubing deforms under the shearing pressure of the intersecting pieces of the chair (2 long bolts) where the back assembly meets the seat assembly.

Figure 8:
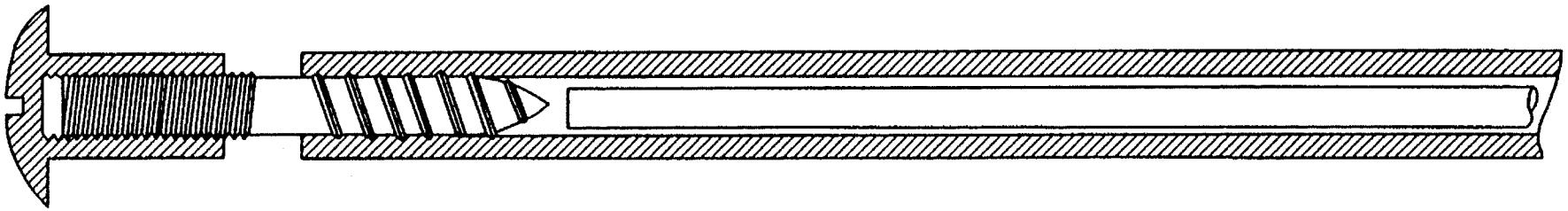
FIG. 8 is a cross-sectional view of a portion of a flexible coupling device of the present invention with a metal rod or wise in the flexible tube.

While a solid rod rather than tubing would be an improvement (greater shearing resistance) it is considerably more expensive and also more cumbersome to use (it comes in 10 to 20 ft lengths whereas the tubing comes in 500 ft rolls). Plus each end of the rod would need to be precisely drilled for later insertion of the lag bolts, thus increasing production costs and making the end product more expensive. However, this problem can be overcome by inserting a stiff wire of sufficient gauge (12.5 in gauge ¼" O.D. tubing) inside the tubing before closing off the ends with retaining means as shown in FIG. 8. In particular, high tensile strength fine wire sold in rolls, or, even better, insulation holders which are cut at 16" and 24" lengths already, work quite well for the chair shown in FIGS. 1 and 2.

Variations of this idea would make the flexible bolt more useful in other application's besides furniture assembly. For instance, if rigidity were not desired, ordinary wire could be used in which case the bolt could be shaped to "remember" curves and bends in an assembly, or, woven cable even metal cable could be used to help resist fatigue in—applications with frequent bending, curving, or vibration (Example: ultra light airplane assembly).

A beneficial feature of this invention is that this article of knock-down furniture 5 and the contact joint assembly 18 herein described are not complicated and do not require special tools or procedures to assemble. Thus, the end-user consumer can easily assembly an entire article of knock-down furniture in a short period of time. Further, the contact joint assembly in the preferred embodiment of the present invention allows adjustment of the tension in the tube so that as the tube stretches after several uses the resulting slack in the tube can be eliminated. Another benefit of the present embodiment is that the article of furniture can be just as easily disassembled.

The material of the flexible tubing or rod can be any material having high-strength and flexibility characteristics. The tube or rod must have sufficient tensile strength to withstand the tension under which it operates. It must have sufficient flexural strength to endure periodic flexing as the furniture is opened and closed or subject to external loads. The tubing or rod must also be capable of receiving and retaining threads. The flexible tubing or rod can be a high-strength nylon tubing of the type produced by The Polymer Corporation under the mark Nylaflow. For example, in applicant's preferred work to date, the tube has an outer diameter of ¼ inch and an inner diameter of ⅛ inch. Each hanger bolt is of a type commercially available at most hardware stores and is 1½ inches long and has a diameter of 3/16 inch, slightly larger than the inner diameter of the flexible tube so that the hanger bolt can cut threads into the tube when assembled. The hanger bolt is threaded into the tube so that about a ½ inch of the second threaded portion is exposed beyond the tube. The cap nut is also commercially available and has a threaded portion ⅝ inches long with an outer diameter of ¼ inch and an inner thread diameter of 3/16 inch to receive the 3/16 inch diameter threads of the hanger bolt. The mounting surface of the head portion of the cap nut has a diameter of ½ inch, thus the common bore in the first and second pieces must have a diameter between ¼ and ½ inch in order to receive the cap nut threaded portion without having the cap nut fall into the common bore.

Each of the embodiments of the present invention herein described represent a new and useful means for coupling two or more pieces in an article of knock-down furniture. Each is inexpensive and easy to understand and assemble by an end-user consumer. The components of the assembly, namely the flexible tube or rod, hanger bolts, cap nuts, or, alternatively, the sheet metal screws and washers, are all commercially available in most hardware stores. The retaining sleeve and retaining posts are formed from oversized rod or tube of the same material as the flexible tube or rod, or molded from the same material.

The foregoing description has been directed to particular embodiments of the invention in accordance with the requirements of the Patent Statutes for the purposes of illustration and explanation. It will become apparent, however, to those skilled in the art that many modifications and changes will be possible without departure from the scope and spirit of the invention. It is intended that the following claims be interpreted to embrace all such modifications.

I claim:

1. A flexible coupling device for coupling a plurality of pieces each including an aligned bore, wherein said flexible coupling device comprises:

a) a flexible tube that is a hollow solid wall cylinder;

b) a flexible metal rod or wire placed inside said flexible tube such that said flexible metal rod is not in axial tension; and c) means for removably securing said flexible tube through said aligned bores of said pieces, and in axial tension between, thereby holding each of said pieces in a fixed longitudinal relationship, while permitting relative rotation between each of said pieces and allows said flexible metal rod to remain within said flexible tube without being in axial tension when said tube is in axial tension.

2. The flexible coupling device of claim 1 wherein said means for securing said flexible tube comprises:

d) a hanger bolt inserted in an end of said flexible tube such that a threaded section of said hanger bolt is exposed beyond the end of the tube; and e) a cap nut having a threaded bore and a mounting surface with an effective diameter larger than the effective diameter of said aligned bore wherein said threaded bore engages said exposed threaded section of said hanger bolt and secures said flexible tube.

3. The flexible coupling device of claim 2 wherein said means for securing said flexible tube further comprise a sleeve for said flexible tube having an inner bore with retaining projections that engage said flexible tube and retaining projections on the exterior of said sleeve that engage the interior of said bores in said pieces when said sleeve is inserted over said flexible tube and into said bore within one of said pieces such that said sleeve prevents that rotation of said tube within said bore.

4. The flexible coupling device of claim 1 wherein said means for securing said flexible tube comprises:

d) radial angular ridges in the interior of said flexible tube; and e) a retaining post having a mounting surface with an effective diameter larger than the effective diameter of said aligned bore and radial angular ridges that interlock with said ridges in said flexible tube such that as said post is inserted into said flexible tube said post ridges and said tube ridges interlock to secure said flexible tube.

5. A flexible coupling device, for coupling a plurality of pieces each including an aligned bore, wherein said flexible coupling device comprises:

a) a flexible rod with a first and second end each having radial angular ridges on the exterior of said flexible rod;

b) a first and second retaining post having a mounting surface with an effective diameter larger than the effective diameter of said aligned bore and an interior bore with radial angular ridges that correspond to said ridges on said flexible rod such that as said flexible rod is inserted into said first and second retaining posts, said post ridges and said rod ridges interlock to secure said flexible rod through said aligned bores of said pieces, and in axial tension between, thereby holding each of said pieces in a fixed longitudinal relationship, while permitting relative rotation between each of said pieces, wherein said retaining post includes a larger bore to allow a tool with interior ridges to engage said exterior ridges of said flexible rod.

6. The flexible coupling device of claim 5 wherein said flexible rod can be pulled through said retaining post such that the excess of said flexible rod can be trimmed once it is secured.

7. A method of coupling a plurality of pieces comprising the steps of:

a) providing an aligned bore in each of said plurality of pieces;

b) providing a flexible tube that is a hollow solid wall cylinder, having a first and second end;

c) providing a restraining element in a fixed relationship with said first end;

d) providing a flexible metal rod or wire placed within said flexible tube such that said flexible metal rod is not is axial tension;

e) stringing said flexible tube through said aligned bores of said pieces; and f) securing said second end of said flexible tube to create axial tension between said pieces, thereby holding each of said pieces in a fixed longitudinal relationship, while permitting relative rotation between each of said pieces and allowing said flexible metal rod to remain within said flexible tube without being in axial tension when said tube is in axial tension.

8. The method of claim 7 wherein said means for securing said flexible tube comprises:

d) a hanger bolt inserted in an end of said flexible tube such that a threaded section said hanger bolt is exposed beyond the end of the tube; and e) a cap nut having a threaded bore and a mounting surface with an effective diameter larger than the effective diameter of said aligned bore wherein said threaded bore engages said exposed threaded section of said hanger bolt and secures said flexible tube.

9. The method of claim 7 wherein said means for securing said flexible tube comprises:

d) radial angular ridges in the interior of said flexible tube; and e) a retaining post having a mounting surface with an effective diameter larger than the effective diameter of said aligned bore and radial angular ridges that interlock with said ridges in said flexible tube such that as said post is inserted into said flexible tube said post ridges and said tube ridges interlock to secure said flexible tube.

10. The method of claim 7 wherein said means for securing said flexible tube further comprise a sleeve for said flexible tube having an inner bore with retaining projections that engage said flexible tube and retaining projections on the exterior of said sleeve that engage the interior of said bores in said pieces when said sleeve is inserted over said flexible tube and into said bore within one of said pieces such that said sleeve prevents that rotation of said tube within said bore.

11. A method of coupling a plurality of pieces comprising the steps of:

a) providing an aligned bore in each of said plurality of pieces, said plurality of pieces;

b) providing a flexible rod with a first and second end having radial angular ridges on the exterior of said flexible rod;

c) providing a restraining element in a fixed relationship with said first end;

d) stringing said flexible rod through said aligned bores of said pieces; and e) securing said second end of said flexible rod to create axial tension between said pieces, thereby holding each of said pieces in a fixed longitudinal relationship, while permitting relative rotation between each of said pieces with a retaining post having a mounting surface with an effective diameter larger than the effective diameter of said aligned bore and an interior bore with radial angular ridges that interlock with said ridges on said flexible rod such that as said flexible rod is inserted into said retaining post, said post ridges and said rod ridges interlock to secure said flexible rod, wherein said retaining post includes a larger bore to allow a tool with interior ridges to engage said exterior ridges of said flexible rod.

12. The method of claim 11 wherein said flexible rod can be pulled through said retaining post such that the excess of said flexible rod can be trimmed once it is secured.

* * * * *